US012429044B2

(12) United States Patent
Dauwe et al.

(10) Patent No.: US 12,429,044 B2
(45) Date of Patent: Sep. 30, 2025

(54) METHOD FOR CONTROLLING A FIRST REFERENCE TEMPERATURE IN A DEVICE FOR COMPRESSING GAS

(71) Applicant: ATLAS COPCO AIRPOWER, NAAMLOZE VENNOOTSCHAP, Wilrijk (BE)

(72) Inventors: Bram Julien Dauwe, Wilrijk (BE); Pieter Guy Monique De Schamphelaere, Wilrijk (BE); Brice Hugo Lefevre, Wilrijk (BE); Senne Bultinck, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/730,107

(22) PCT Filed: Dec. 14, 2022

(86) PCT No.: PCT/IB2022/062189
§ 371 (c)(1),
(2) Date: Jul. 18, 2024

(87) PCT Pub. No.: WO2023/144612
PCT Pub. Date: Aug. 3, 2023

(65) Prior Publication Data

US 2025/0146486 A1 May 8, 2025

(30) Foreign Application Priority Data

Jan. 25, 2022 (BE) ..... 2022/5048

(51) Int. Cl.
*F04B 49/06* (2006.01)
*F04B 39/02* (2006.01)
(Continued)

(52) U.S. Cl.
CPC ..... *F04B 49/06* (2013.01); *F04B 39/0207* (2013.01); *F04B 39/062* (2013.01);
(Continued)

(58) Field of Classification Search
CPC .. F04B 49/065; F04B 39/0207; F04B 39/062; F04B 39/066; F04B 49/06;
(Continued)

(56) References Cited

U.S. PATENT DOCUMENTS 7,114,913 B2 10/2006 Coker
8,622,716 B2 1/2014 Tanaka et al.
(Continued)

FOREIGN PATENT DOCUMENTS

EP 2 610 495 A1 7/2013
JP 09-158839 A 6/1997
(Continued)

OTHER PUBLICATIONS

International Search Report for PCT/IB2022/062189, dated Mar. 20, 2023.
Written Opinion for PCT/IB2022/062189, dated Mar. 20, 2023.

*Primary Examiner* — Mary A Davis
(74) *Attorney, Agent, or Firm* — Sughrue Mion, PLLC

(57) ABSTRACT

A method for controlling a first reference temperature in a device (1) for compressing gas, the device (1) including an oil-injected element (2) for compressing the gas; an oil injection pipe network (6) for injecting oil into the oil-injected element (2), including: an apportioning means (8) for apportioning the oil into a first part and into a second part; an oil cooler (10) cooled by a fan (9), for cooling the first part; and a bypass (11) for diverting the second part past the oil cooler (10). An apportioning proportion of the first part is controlled to a required apportioning proportion, and subsequently a speed of the fan (9) is controlled to a required
(Continued)

speed optionally on the basis of the apportioning proportion, wherein the apportioning proportion is controlled by a control unit (15) on the basis of a non-fuzzy logic algorithm.

26 Claims, 2 Drawing Sheets

(51) Int. Cl.
*F04B 39/06* (2006.01)
*F04C 29/04* (2006.01)

(52) U.S. Cl.
CPC ..... *F04B 39/066* (2013.01); *F04B 49/065* (2013.01); *F04C 29/04* (2013.01); *F04C 29/042* (2013.01); *F04B 2201/0402* (2013.01); *F04B 2203/021* (2013.01); *F04B 2205/10* (2013.01); *F04B 2205/11* (2013.01)

(58) Field of Classification Search
CPC ..... F04B 2201/0402; F04B 2203/021; F04B 2205/10; F04B 2205/11; F04C 29/04; F04C 29/042
See application file for complete search history.

(56) References Cited

U.S. PATENT DOCUMENTS

| | | | | |
|---|---|---|---|---|
| 11,073,148 | B2 * | 7/2021 | Coeckelbergs ..... | F04B 49/065 |
| 12,018,678 | B2 * | 6/2024 | Broucke ..... | F04C 29/04 |
| 2008/0206085 | A1 * | 8/2008 | Zieglgansberger ..... | F04C 29/04 418/85 |
| 2024/0353878 | A1 * | 10/2024 | Yuan ..... | F04B 39/066 |

FOREIGN PATENT DOCUMENTS

| | | | |
|---|---|---|---|
| RU | 2 681 402 | C2 | 3/2019 |
| WO | 2018/025368 | A1 | 2/2018 |
| WO | 2018/033827 | A1 | 2/2018 |

* cited by examiner

METHOD FOR CONTROLLING A FIRST REFERENCE TEMPERATURE IN A DEVICE FOR COMPRESSING GAS

CROSS REFERENCE TO RELATED APPLICATIONS

This application is a National Stage of International Application No. PCT/IB2022/062189 filed Dec. 14, 2022, claiming priority based on Belgium Patent Application No. 2022/5048 filed Jan. 25, 2022.

The present invention relates to a method for controlling a first reference temperature in a device for compressing gas to a desired temperature value.

A "device for compressing gas" in this context may refer to both a compressor device for compressing an atmospheric gas to a superatmospheric pressure and a vacuum pump device for vacuum suctioning a user network or an enclosed space.

More particularly, the invention relates to a method for controlling a first reference temperature in the device to a first desired temperature value, wherein the device comprises the following components:

an oil-injected element for compressing the gas;

an oil injection pipe network with a discharge for injecting oil into the oil-injected element, comprising:

an apportioning means for apportioning the oil into a first part and into a second part;

an oil cooler cooled by a fan, for cooling the first part; and a bypass for diverting the second part past the oil cooler, wherein firstly an apportioning proportion of the first part is controlled to a required apportioning proportion for directing a second reference temperature in the device to a second desired temperature value, and wherein subsequently a speed of the fan is controlled to a required speed for directing the first reference temperature to the first desired temperature value.

A "reference temperature in the device" in this context means a temperature at a specific reference location in the device, for example at an outlet of the oil-injected element where a temperature of the gas in the device is typically highest, or at a discharge of the oil injection pipe network where a temperature of the oil is critical for cooling and lubricating the device.

An "apportioning proportion of the first part" in this context means a ratio of a flow rate or quantity of the first part to a total flow rate or total quantity of the oil. Consequently, this apportioning proportion can range from 0 to 100%.

A need and methods for controlling a certain reference temperature in a device for compressing gas to a desired temperature value are already known.

On the one hand, it may be that the reference temperature should not fall below a minimum level, for example to avoid formation of condensate from the gas, which would have a negative effect on a cooling or lubricating capacity of oil in the device and also a corrosive and consequently life-shortening effect on components of the device. On the other hand, it may be that the reference temperature should not rise above a maximum level in order to avoid damage to the device, for example due to quality degradation of the oil in the device or even deformation of components in the device.

In some existing devices with an oil-injected element for compressing gas and an oil injection pipe network for injecting oil into this oil-injected element, the reference temperature is controlled to the desired temperature using a thermostat control valve with a fixed temperature setpoint and a fixed-speed fan for cooling the oil in the oil injection pipe network, wherein the fan is stopped when the reference temperature is below the maximum level.

Tests have shown that the device is not always energy efficient when using a thermostat control valve with a fixed temperature setpoint and a fan with a fixed speed. Even if the reference temperature were not to significantly exceed the maximum level, the fan would always be started up at its fixed speed, which causes the reference temperature to decrease rapidly and also requires the fan to be stopped again quickly. In the worst case, the reference temperature decreases so much that it drops below the minimum level, resulting in an increased risk of condensate formation in the device.

Other existing devices use a thermostat control valve controlled by a PID controller and a variable-speed fan. Such systems typically have separate control circuits for controlling the thermostat control valve and the fan.

Tests have shown that these types of devices can exhibit irregular and oscillatory behavior due to interference between the separate control circuits. Negative consequences of this include the possible occurrence of emergency shutdowns of the device, damage to mechanical components of the device, and premature wear of various components of the device.

WO 2018/033827 A1 describes a method for controlling an outlet temperature of a device having an oil-injected element for compressing gas and an oil injection pipe network for injecting oil into the oil-injected element, wherein a position of a thermostat control valve is controlled by applying a fuzzy logic algorithm at a measured value for the outlet temperature, and wherein a speed of a fan for cooling the oil is controlled by applying the fuzzy logic algorithm and further on the basis of the position of the thermostat control valve.

The disadvantage of using a fuzzy logic algorithm is that it is a complex "multiple input-multiple output" (MIMO) computational algorithm.

The present invention aims at solving at least one of the said and/or other disadvantages.

More specifically, the object of the present invention is to provide a simple method for controlling a reference temperature in a device for compressing gas to a desired temperature value, wherein, on the one hand, as much use as possible is made of separate sub-circuits with computational algorithms that are as simple as possible, but on the other hand, there is also as little interference as possible between the separate control circuits in the device.

To this end, the invention relates to a method for controlling a first reference temperature in a device for compressing gas to a desired temperature value, wherein the device comprises the following components:

an oil-injected element for suctioning the gas at an inlet of the device and compressing this gas to an operating pressure at an outlet of the oil-injected element;

an oil injection pipe network with a discharge for injecting oil into the oil-injected element, comprising:

an apportioning means for apportioning the oil into a first part and into a second part;

an oil cooler cooled by a fan, for cooling the first part; and a bypass for diverting the second part past the oil cooler, wherein firstly a required apportioning proportion of the first part is determined for directing a second reference temperature in the device to a second desired temperature value; and an apportioning proportion for the first part is controlled to the required apportioning proportion, and wherein subsequently a required speed of the fan is determined for directing the first reference temperature to the first desired temperature value, wherein, if the first reference temperature is the same as the second reference temperature, the required speed is determined on the basis of the second desired temperature value and the apportioning proportion; and a speed of the fan is controlled to the required speed, with the characteristic that the apportioning proportion is controlled using a control unit on the basis of a non-fuzzy logic algorithm with the following as input a first current value for the second reference temperature; and the second desired temperature value.

The advantage of this is that the apportioning proportion is controlled by a standard control unit such as, for example, a PID controller or an ON/OFF controller. Consequently, the use of a complex "multiple input-multiple output" computational algorithm as described in WO 2018/033827 A1 is avoided.

Nevertheless, the device according to the invention has the same basic advantages as those described in WO 2018/033827 A1.

More specifically, the method according to the invention, if the first reference temperature is the same as the second reference temperature, also avoids any interference between controlling the apportioning proportion and controlling the fan speed. This is in complete contrast to the danger of this type of interference that WO 2018/033827 A1, on page 2, lines 18-27, precisely warns against in the case of devices using a SISO control unit for controlling the apportioning proportion and a variable-speed fan.

In a preferred embodiment of the method according to the invention, the second desired temperature value is determined on the basis of a highest temperature value in a group of one or more temperature values.

As a result, the second desired temperature value may be determined on the basis of a desired number of objectives.

Moreover, the second desired temperature value may be adjusted to a most relevant objective which depends on an operating regime of the device.

In a more preferred embodiment of the method according to the invention, a first temperature value in the said group is representative of a value of the second reference temperature at which a temperature of the compressed gas at the outlet is equal to a first condensation temperature of the compressed gas at the outlet; or the first condensation temperature plus a first safety margin.

In this way, when the second desired temperature value is determined, a first objective in terms of avoiding condensate formation in the device is taken into account.

Preferably, the first temperature value is limited in this respect according to a first temperature interval between a first minimum temperature limit value and a first maximum temperature limit value.

This means that:

when the first temperature value is lower than the first minimum temperature limit value, the first temperature value is set equal to the first minimum temperature limit value;

when the first temperature value is higher than the first maximum temperature limit value, the first temperature value is set equal to the first maximum temperature limit value; and when the first temperature value is in the first temperature interval between the first minimum temperature limit value and the first maximum temperature limit value, the first temperature value is not changed.

By limiting the first temperature value to the first temperature interval, safety constraints can be taken into account, for example with respect to a minimum and maximum operating temperature of the device.

In a further more preferred embodiment of the method according to the invention, a second temperature value in the said group is representative of a value of the second reference temperature at which a specific energy requirement of the device is minimal.

In this way, when the second desired temperature value is determined, a second objective in terms of minimizing a specific energy requirement and consequently maximizing an energy efficiency of the device is taken into account.

Preferably, the second temperature value is determined on the basis of at least a second current value representative of the operating pressure; and a third current value representative of a temperature of the gas at the inlet.

In the context of the invention, a "current value representative of" a certain parameter does not necessarily mean that the current value is equal to a value for this parameter, but rather that the current value can be derived from the value for this parameter.

In this way, the second temperature value is determined on the basis of two standard state variables of the device, for which standard state variables a value can be reliably and easily measured using accurate, relatively inexpensive and readily available sensors.

More preferably, in the case that the oil-injected element is driven by a variable-speed motor, the second temperature value is further determined on the basis of a tenth current value representative of a rotational speed of the variable-speed motor.

As a result, when the second temperature value is determined, account is taken of the rotational speed of the variable-speed motor and consequently a variable power supplied by this variable-speed motor to the gas compression process.

Further, the second temperature value is alternatively or additionally preferably limited according to a second temperature interval between a second minimum temperature limit value and a second maximum temperature limit value.

This means that:

when the second temperature value is lower than the second minimum temperature limit value, the second temperature value is set equal to the second minimum temperature limit value;

when the second temperature value is higher than the second maximum temperature limit value, the second temperature value is set equal to the second maximum temperature limit value; and when the second temperature value is in the second temperature interval between the second minimum temperature limit value and the second maximum temperature limit value, the second temperature value is not changed.

By limiting the second temperature value to the second temperature interval, safety constraints can be taken into account, for example with respect to a minimum and maximum operating temperature of the device.

In a further more preferred embodiment of the method according to the invention the second reference temperature is controlled from an old temperature value to the second desired temperature value; and to determine the second desired temperature value, the said highest temperature value is limited according to a third temperature interval between, on the one hand, the old temperature value minus a maximum temperature decrease value and, on the other hand, the old temperature value plus a maximum temperature increase value.

In this way, a change in the second reference temperature can be limited when the second reference temperature is controlled to the second desired temperature value, for example to take into account safety constraints related to temperature changes in the device.

Preferably, the second reference temperature is controlled in a predefined time interval from the old temperature value to the second desired temperature value, and the maximum temperature decrease value and the maximum temperature increase value are positively dependent on a length of the predefined time interval.

In this way, a change in the second reference temperature according to the predefined time interval can be limited, for example to take into account safety constraints related to a maximum absolute temperature-time gradient in the device.

In a further more preferred embodiment of the method according to the invention, the required apportioning proportion is determined on the basis of a first ratio between the first current value and the second desired temperature value.

This first ratio is a measure of a deviation of the first current value from the second preferred temperature value.

If the first ratio is less than 1, this is an indication of too low a value for the second reference temperature, and the required apportioning proportion should be selected to be lower than a current value for the apportioning proportion if possible, such that less oil is sent to the oil cooler and consequently the oil to be injected is cooled less, which will increase the second reference temperature.

If the first ratio is greater than 1, this is an indication of too high a value for the second reference temperature, and the required apportioning proportion should be selected to be higher than the current value for the apportioning proportion, such that more oil is sent to the oil cooler and consequently the oil to be injected is cooled more, which will reduce the second reference temperature.

Preferably, the required apportioning proportion, between a minimum zero value and a maximum value of 100%, is dependent on the first ratio according to a first monotonically increasing function.

In this way, a change in the apportioning proportion to the required apportioning proportion is never smaller when there is a greater deviation between the second reference temperature and the second desired temperature value.

Alternatively, the required apportioning proportion is preferably a maximum value of 100% when the first current value is higher than the second desired temperature value or the second desired temperature value plus a second safety margin; or is higher during a first period than the second desired temperature value or the second desired temperature value plus the second safety margin; and is otherwise a minimum zero value.

This is a simple ON/OFF control in which the oil is entirely sent to the oil cooler when there is an indication that the reference temperature might be too high, more specifically higher than the second desired temperature value plus or not plus the second safety margin.

By applying the first period before controlling the apportioning proportion to a condition in which the oil is entirely sent to the oil cooler, rapid and unnecessary switching of an apportioning proportion from the minimum zero value to the maximum value of 100% and back to the zero value can be avoided. This would otherwise occur if the second reference temperature were higher than the second desired temperature plus or not plus the second safety margin only for a limited non-harmful time period shorter than the first period.

Hence, by applying the first period, a control dynamic of the apportioning means and the device is generally not or less responsive with respect to non-harmful short-term increases in the second reference temperature. Consequently, this control dynamic is more stable than if the first period were not applied.

In a further preferred embodiment of the method according to the invention, the second reference temperature is:

a temperature of the gas at the outlet of the oil-injected element; or a temperature of the oil at the discharge of the oil injection pipe network.

At the outlet of the oil-injected element, a pressure of the gas in the device is the highest. Consequently, a danger of condensate formation is also the highest at this outlet. This is because the higher the pressure of the gas, the higher a condensation temperature of the gas. It must be ensured that the temperature of the gas at the outlet does not fall below the condensation temperature of the gas at this outlet. Thus, the temperature of gas at the outlet of the oil-injected element is a relevant second reference temperature in the device for the purpose of avoiding formation of condensate in the device.

The temperature of the oil at the discharge of the oil injection pipe network in turn determines a cooling capacity of the oil. It must be ensured that this cooling capacity does not become too high in order to prevent a temperature of the gas at a given location in the device from falling below a condensation temperature of the gas at this location. Thus, the temperature of the oil at the discharge of the oil injection pipe network is also a relevant second reference temperature in the device for the purpose of avoiding the formation of condensate in the device.

In a further preferred embodiment of the method according to the invention, the required fan speed is determined on the basis of a highest speed value from a set of one or more speed values.

This allows the required speed to be determined on the basis of a desired number of criteria.

Moreover, the required speed may be adjusted to a most relevant criterion which depends on an operating regime of the device.

In a more preferred embodiment of the method according to the invention, a first speed value in the said set is representative of a value for the fan speed required to achieve the second desired temperature value for the second reference temperature.

In this way, when the required fan speed is determined, a first criterion in terms of achieving the second desired temperature value is taken into account. In other words, control of the fan in this regard has the same purpose as control of the apportioning proportion as described above, and consequently helps to achieve a goal of the control of the apportioning proportion.

In an even further preferred embodiment of the method according to the invention, when

- a fourth current value for the second reference temperature is higher than a predefined minimum temperature; and
- a fifth current value for the apportioning proportion is higher than a predefined minimum apportioning proportion and the fourth current value is higher than the desired temperature value, the first speed value is determined on the basis of at least

- a sixth current value representative of the operating pressure; and
- a seventh current value representative of a temperature of the gas at the inlet.

In this way, the first speed value is determined on the basis of two standard state variables of the device, for which standard state variables a value can be reliably and easily measured using accurate, relatively inexpensive and readily available sensors.

Preferably, in the case that the oil-injected element is driven by a variable-speed motor, the first speed value is further determined on the basis of an eleventh current value representative of a rotational speed of the variable-speed motor.

As a result, when the first speed value is determined, account is taken of the rotational speed of the variable-speed motor and consequently a variable power supplied by this variable-speed motor to the gas compression process.

Alternatively or additionally preferably, when

- the fourth current value is higher than the second desired temperature value plus a first tolerance value; or
- during a second period, the fourth current value is higher than the second desired temperature value plus a first tolerance value; or
- the fourth current value is lower than the second desired temperature value minus a second tolerance value; or
- during a third period, the fourth current value is lower than the second desired temperature value minus the second tolerance value, the first speed value is further determined on the basis of at least

- the fifth current value for the apportioning proportion; and
- a second ratio between the fourth current value and the second desired temperature value.

By determining the first speed value on the basis of the fifth current value for the apportioning proportion, the apportioning proportion can be taken into account when determining the fan speed, thus avoiding any interference between the fan speed control and the apportioning proportion control.

The second ratio is a measure of a deviation of the fourth current value from the second desired temperature value.

If the second ratio is less than 1, this is an indication of too low a value for the second reference temperature, and the required apportioning proportion should be selected to be lower than a current value for the apportioning proportion, such that less oil is sent to the oil cooler and consequently the oil to be injected is cooled less, which will increase the second reference temperature.

If the second ratio is greater than 1, this is an indication of too high a value for the second reference temperature, and the required apportioning proportion should be selected to be higher than a current value for the apportioning proportion, such that more oil is sent to the oil cooler and consequently the oil to be injected is cooled more, which will reduce the second reference temperature.

With greater preference, the first speed value depends on the second ratio according to a second monotonically increasing function.

In this way, a change in the fan speed to the first speed value is never smaller when there is a greater deviation between the second reference temperature and the second preferred temperature value.

Alternatively or additionally, with greater preference, the first speed value is dependent on the fifth current value according to a third monotonically increasing function.

As a result, when controlled to the first speed value, the fan speed will never become smaller when the apportioning proportion increases and never become larger when the apportioning proportion decreases.

This benefits stability in the fan speed control, since the fan speed can be gradually raised when the apportioning proportion increases and gradually reduced when the apportioning proportion decreases. This can prevent the fan from suddenly having to start up from standstill at high speed when the apportioning proportion rises from a zero value, or the fan from suddenly being brought to a standstill from a high speed when the apportioning proportion suddenly drops to a zero value.

In a further more preferred embodiment, when the device is provided with an aftercooler for cooling the compressed gas downstream of the oil-injected element,

- when an eighth current value for a lowest available temperature in the aftercooler is higher than a value for a required lowest available temperature, a second speed value in the set is determined on the basis of
  - the first speed value; and
  - a third ratio between the eighth current value and the value for the required lowest available temperature; and
- otherwise, the second speed value is set equal to zero.

In this way, the fan speed can be controlled to the second speed value that is higher than the first speed value, when the eighth current value for the lowest available temperature in the aftercooler has too high a value. This allows the fan, in addition to cooling the oil cooler, to be utilized to sufficiently cool the aftercooler, such that a maximum temperature of the gas in the aftercooler can be controlled and limited to the required lowest available temperature.

Preferably, the required lowest available temperature is equal to a value for the second condensation temperature of the gas in the aftercooler plus an offset.

Formation of condensate in the aftercooler can be avoided by means of the offset.

Alternatively or additionally, the second speed value is preferably dependent on the third ratio according to a fourth monotonically increasing function.

In that case, if there is a larger deviation of the lowest available temperature above the value for the required lowest available temperature, the second speed value will not reduce, such that the lowest available temperature cannot deviate further from the value for the required lowest available temperature at an accelerated rate.

In a further more preferred embodiment of the method according to the invention, a third speed value in the set is determined on the basis of

- a ninth current value for the first reference temperature; and
- a predefined maximum value for the first reference temperature, wherein the third speed value is equal to zero when the ninth current value is lower than the predefined maximum value; and a value representative of a maximum speed of the fan when the ninth current value is higher than the predefined maximum value.

In this way, the fan speed may be adjusted to a third speed value determined by the exceeding of the predefined maximum value, which predefined maximum value is, for example, a maximum value for the first reference temperature of the gas above which the first reference temperature must not rise for safety reasons.

The invention further relates to a computational control assembly comprising a first computational control unit provided with a control unit for controlling a second reference temperature in a device for compressing gas to a second desired temperature value; and a second computational control unit for controlling a first reference temperature in the device to a first desired temperature value for performing a method according to any one of the embodiments described above.

Finally, the invention relates to a device for compressing gas provided with such a computational control assembly according to the invention.

It is evident that such a computational control assembly and such a device exhibit the same advantages as the methods according to the embodiments of the invention which are described above.

To better illustrate the features of the invention, the following describes, by way of example without any restrictive character, a number of preferred embodiments of a method, computational control assembly and device according to the invention, with reference to the accompanying drawings, in which.

Figure 1:
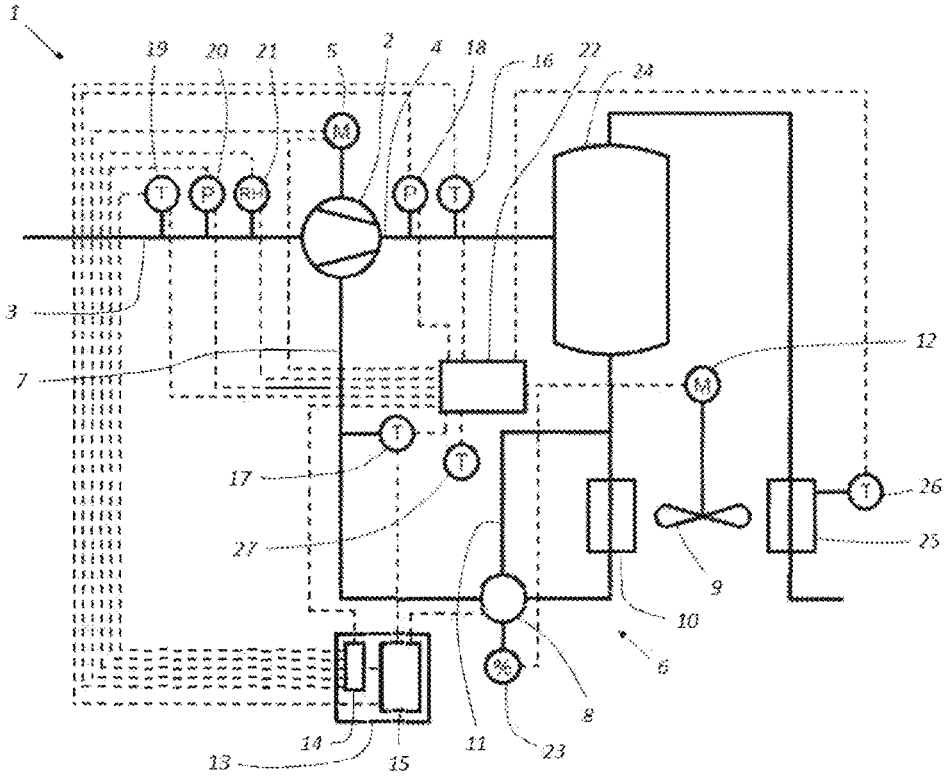
FIG. 1 shows a device provided with a computational control assembly according to the invention.

FIG. 1 shows a device 1 for compressing gas, which device 1 comprises an oil-injected element 2 for suctioning the gas at an inlet 3 of the device 1 and compressing this gas to an operating pressure at an outlet 4 of the oil-injected element 2.

In the scope of the invention, the device 1 is to be interpreted as a complete compressor or vacuum pump installation including, inter alia, the oil-injected element 2 in the form of a compressor or vacuum pump element, respectively, all typical connecting pipes and valves, a possible housing of the device 1 and a motor 5 driving the oil-injected element 2.

In the context of the present invention, the oil-injected element 2 is to be understood as an element housing in which the gas is compressed by means of a rotating rotor movement or by a reciprocating piston movement.

In this respect, as a non-limiting example, the oil-injected element 2 may comprise one or more screw rotors, gear rotors, baffles, lobes or pistons.

When the device 1 comprises a compressor element, the inlet 3 of the device 1 is typically fluidically connected to an atmospheric environment of the device 1. When the device 1 comprises a vacuum pump element, the inlet 3 is typically fluidically connected to a user network or an enclosed space at sub-atmospheric pressure.

Further, the device 1 also comprises an oil injection pipe network 6 having a discharge 7 for injecting oil into the oil-injected element 2.

In this regard, it is not precluded within the scope of the invention that the oil injection pipe network 6 comprises multiple discharges 7 for injecting oil into the oil-injected element 2.

The compression of the gas in the oil-injected element 2 generates compression heat which heats up the gas. In order to keep a temperature of the compressed gas at the outlet 4 of the oil-injected element 2 below a certain maximum safety limit, a temperature of the injected oil should be below a maximum level corresponding to this safety limit. On the other hand, the temperature of the compressed gas at the outlet 4 must also not fall below a first condensation temperature of the gas at the outlet 4 or below the first condensation temperature plus a first safety margin in order to avoid formation of condensate at the outlet 4. Consequently, the temperature of the injected oil must be above a minimum level corresponding to this first condensation temperature or to this first condensation temperature plus the first safety margin. The temperature of the gas at the outlet 4 of the oil-injected element 2 and accordingly the temperature of the oil at the discharge 7 of the oil injection pipe network 6 should thus be controlled to a value within a temperature interval correspondingly limited at both ends.

For this purpose, the oil injection pipe network 6 comprises an apportioning means 8 for apportioning the oil into a first part and into a second part, such as, for example, a thermostatic control valve;

an oil cooler 10 cooled by a fan 9, for cooling the first part; and a bypass 11 for diverting the second part past the oil cooler 10.

The fan 9 has a variable speed and is driven by means of a second motor 12. This makes it possible, for example, to control the cooling of the first part of the oil to be injected by adjusting the speed of the fan 9.

More generally, in the present invention, the speed of the fan 9 is adjusted such that a first reference temperature in the device 1 is controlled to a first desired temperature value.

The apportioning means 8 and the bypass 11 are provided for diverting a second part of the oil to be injected past the oil cooler 10, and thus limiting more or less the cooling by the oil cooler 10 of the oil to be injected by controlling an apportioning proportion of the first part of the oil. In this manner, a second reference temperature in the device 1 may be controlled to a second desired temperature value, wherein the second reference temperature is, for example, a temperature of the compressed gas at the outlet 4 of the oil-injected element 2 or a temperature of the oil at the discharge 7 of the oil injection pipe network 6. The first reference temperature, which is controlled by the fan 9, may be the same as the second reference temperature, wherein the first desired temperature value is thus also equal to the second desired temperature value.

For controlling the apportioning proportion, the device 1 is provided with a first computational control unit 13. This first computational control unit 13 comprises a computational unit 14 for determining the second desired temperature value; and a control unit 15 for adjusting the apportioning proportion of the first part to the second desired temperature on the basis of a first current value for the second reference temperature.

In this case, the control unit 15 is designed as, for example, a PID controller or an ON/OFF controller.

In this case, the first current value for the second reference temperature is provided by measurement using a temperature sensor, for example a first temperature sensor 16 at the outlet 4 of the oil-injected element 2 or a second temperature sensor 17 at the discharge 7 of the oil injection pipe network 6.

The second desired temperature value is determined by the computational unit 14 on the basis of at least:

a second current value representative of the operating pressure, which second current value is provided, for example, by measurement using a first pressure sensor 18 at the outlet 4 of the oil-injected element 2; and a third current value representative of a temperature of the gas at the inlet 3, which third current value is provided, for example, by measurement using a third temperature sensor 19 at the inlet 3 of the device 1.

Additionally, it is also possible to take into account a measurement of an atmospheric pressure at the inlet 3, which measurement is provided, for example, using a second pressure sensor 20 at the inlet 3 of the device 1. However, it is also possible to simply assume an absolute standard value of 1 bar or 1 atmosphere for the atmospheric pressure, which means that measurement of this atmospheric pressure and consequently the second pressure sensor 20 are not strictly necessary for the invention.

It is likewise possible to take into account a measurement of a relative humidity at the inlet 3, for example using a humidity sensor 21 at the inlet 3. Alternatively, a worst-case relative humidity value of 100% may also be assumed for this gas at the inlet 3. In the latter case, the measurement of the relative humidity at the inlet 3 and consequently the humidity sensor 21 are not strictly necessary for the invention.

On the basis of the second desired temperature value determined by the computational unit 14 and the first current value for the second desired temperature value, the control unit 15 will determine the required apportioning proportion and control the apportioning proportion of the first part of the oil to this required apportioning proportion.

In the case of FIG. 1, the apportioning means 8 is positioned downstream of the oil cooler 10 and the bypass 11. However, in the context of the invention, the apportioning means 8 is not precluded from being positioned upstream of the oil cooler 10 and/or the bypass 11, for example at a point where a pipe to the oil cooler 10 and the bypass 11 branch off from each other.

For controlling the speed of the fan 9, the device 1 is provided with a second computational control unit 22.

The second computational control unit 22 forms, together with the first computational control unit 13, a computational control assembly according to the invention.

Control of the fan 9, like control of the apportioning proportion of the first part of the oil as already described above, may have the purpose of controlling the second reference temperature to the second desired temperature value. In that case, the first reference temperature will therefore be the same as the second reference temperature and the first desired temperature value will be equal to the second desired temperature value.

When, in that case, a fourth current value for the second reference temperature is higher than the second desired temperature value and a fifth current value for the apportioning proportion is higher than a predefined minimum apportioning proportion, the required speed of the fan 9 is then determined by the second computational control unit 22 on the basis of at least:

a sixth current value representative of the operating pressure, which sixth current value is provided, for example, by measurement using the first pressure sensor 18 at the outlet 4 of the oil-injected element 2; and a seventh current value representative of a temperature of the gas at the inlet 3, which seventh current value is provided, for example, by measurement using the third temperature sensor 19, respectively.

The fourth current value may be provided, for example, by measurement using the first temperature sensor 16 or the second temperature sensor 17.

The second desired temperature value is obtained by the second computational control unit 22 from the computational unit 14.

In order to then be able to take into account the apportioning proportion of the first part of the oil when controlling the speed of the fan 9, the fifth current value for the apportioning proportion can also be taken into account for determining a specific value for the required speed of the fan 9. This fifth current value can be provided by measurement using a position or flow sensor 23 in the apportioning means 8 by which the degree of opening of the apportioning means 8 and consequently the apportioning proportion of the first part of the oil can be measured.

It is of course not impossible in the context of the invention for the second computational control unit 22 to obtain the fifth current value directly from the control unit 15 (not shown in FIG. 1). In that case, the position or flow sensor 23 is no longer necessary and can be dispensed with.

FIG. 1 also shows that the gas compressed by the oil-injected element 2 can be passed, for example, through an oil separator 24 in which the compressed gas is purified by separating the oil previously injected into the oil-injected element 2 from the compressed gas, before the thus purified compressed gas leaves the device 1.

Oil separated in the possibly present oil separator 24 may in this case preferably be reinjected into the oil-injected element 2 via the oil injection pipe network 6.

Optionally, the compressed gas, whether purified or not, may also be sent through an aftercooler 25 before leaving the device 1. The compressed gas may be cooled in this aftercooler 25 by the same fan 9 as is used for the oil cooler 10. In that case, it may be that the speed of the fan 9 is controlled such that a lowest available temperature of the gas in the aftercooler 25 is below a required lowest available temperature. The first reference temperature in that case is thus equal to the lowest available temperature of the gas in the aftercooler 25. The fan 9 is controlled on the basis of the required lowest available temperature and an eighth current value for the lowest available temperature, which eighth current value is measured, for example, using a fourth temperature sensor 26 at a suitable location in the aftercooler 25.

The speed of the fan 9 may also be controlled on the basis of a predefined maximum value for the first reference temperature, for example at a location in the device 1 where the temperature is typically relatively high and should remain below the maximum value for safety reasons. Here, the first reference temperature is, for example, a temperature of the motor 5, the second motor 12 or a frequency converter of the device 1. The first reference temperature may also be a temperature of the gas coming out of the aftercooler 25.

The speed of the fan 9 is then controlled using, as input, a ninth current value for the first reference temperature, which ninth current value is then measured, for example, using a fifth temperature sensor 27.

In the context of the invention, it is not impossible for this fifth temperature sensor 27 to coincide with, for example, the first temperature sensor 16 or the second temperature sensor 17.

If the motor 5 is a variable-speed motor, the computational unit 14, when determining the second desired temperature, also takes into account a tenth current value representative of a rotational speed of the motor 5, and the second computational control unit 22, when determining the required speed of the fan 9, may also take into account an eleventh current value representative of the rotational speed of the motor 5.

Figure 2:
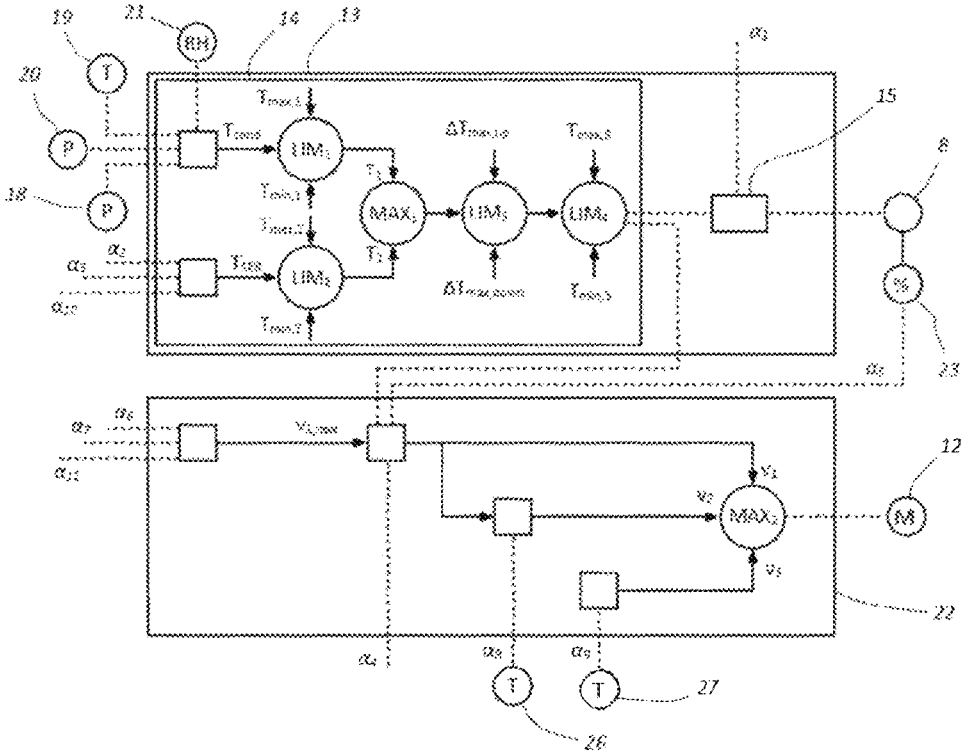
FIG. 2 shows a schematic overall view of a method according to the invention.

A schematic overall view of a method according to the invention is illustrated in FIG. 2.

As already described, a second desired temperature value for the second reference temperature is determined in the computational unit 14.

In this case, the second desired temperature value is determined on the basis of a highest temperature value in a group of two temperature values. This is illustrated in FIG. 2 with a first maximization operator $MAX_1$.

A first temperature value $T_1$ in the said group is thus representative of a value of the second reference temperature at which a temperature of the compressed gas at the outlet 4 of the oil-injected element 2 is equal to the first condensation temperature of the compressed gas at the outlet 4 of the oil-injected element 2 or this first condensation temperature plus the first safety margin.

The first condensation temperature may be determined in a manner known by a person skilled in the art as described, for example, in WO 2018/033827 A1.

When determining the first temperature value, a value $T_{cond}$ representative of the first condensation temperature plus or not plus the first safety margin can in this case still be limited according to a first temperature interval between a first minimum temperature limit $T_{min,1}$ and a first maximum temperature limit $T_{max,1}$. This limitation of the first condensation temperature plus or not plus the first safety margin is performed in a first limitation operator $LIM_1$.

If the second reference temperature is the temperature of the gas at the outlet 4 of the oil-injected element 2, a value for the first minimum temperature limit value $T_{min,1}$ and the first maximum temperature limit value $T_{max,1}$ may vary, for example, between 0° C. and 120° C., and this value may be set with an accuracy of, for example, 1° C.

A second temperature value in the said group is representative of a value $T_{SER}$ of the second reference temperature at which a specific energy requirement of the device 1 is minimal.

When the motor 5 is a fixed-speed motor, this value $T_{SER}$ of the second reference temperature can be calculated on the basis of the second current value $\alpha_2$ representative of the operating pressure and the third current value $\alpha_3$ representative of the temperature of the gas at the inlet 3, for example according to the following equation:

$$T_{SER} = B \cdot \alpha_3 + C \cdot \alpha_2 + D \quad \text{(equation 1)}$$

When the motor 5 is a variable-speed motor, this value $T_{SER}$ of the second reference temperature can be calculated on the basis of the second current value $\alpha_2$ representative of the operating pressure, the third current value $\alpha_3$ representative of the temperature of the gas at the inlet 3 and the tenth current value $\alpha_{10}$ representative of the rotational speed of the motor 5, according to the following equation, for example:

$$T_{SER} = A \cdot \alpha_{10} + B \cdot \alpha_3 + C \cdot \alpha_2 + D \quad \text{(equation 2)}$$

Here, the current value $\alpha_{10}$ is a value for the rotational speed of the motor 5 determined as a percentage of a maximum rotational speed of the motor 5.

In the preceding equations 1 and 2, the value $T_{SER}$ of the second reference temperature is expressed in ° C., the second current value $\alpha_2$ is determined as the operating pressure in bar, and the third current value $\alpha_3$ is determined as the temperature of the gas at the inlet 3 in ° C.

If the second reference temperature is the temperature of the gas at the outlet 4 of the oil-injected element 2, possible value intervals for the constants A, B, C and D in the preceding equations 1 and 2 are:

$$\{A \in \mathbb{Z} \mid 0° \text{ C.} \leq A \leq 64000° \text{ C.}\} \quad \text{(equation 3)}$$

$$\{B \in \mathbb{Z} \mid 0 \leq B \leq 1000\} \quad \text{(equation 4)}$$

$$\{C \in \mathbb{Z} \mid 0° \text{ C./bar} \leq C \leq 255° \text{ C./bar}\} \quad \text{(equation 5)}$$

$$\{D \in \mathbb{Z} \mid -32000° \text{ C.} \leq D \leq 32000° \text{ C.}\} \quad \text{(equation 6)}$$

When the second temperature value $T_2$ is determined, the value $T_{SER}$ can then still be limited according to a second temperature interval between a second minimum temperature limit value $T_{min,2}$ and a second maximum temperature limit value $T_{max,2}$. This limitation of the value $T_{SER}$ is performed by a second limitation operator $LIM_2$.

If the second reference temperature is the temperature of the gas at the outlet 4 of the oil-injected element 2, a value for the second minimum temperature limit value $T_{min,2}$ and the second maximum temperature limit value $T_{max,2}$ may vary, for example, between 0° C. and 120° C., and this value may be set with an accuracy of, for example, 1° C.

Optionally, when the second reference temperature is to be controlled from an old temperature value to the second desired temperature value, the said highest temperature value resulting from the first maximization operator $MAX_1$ can be limited according to a third temperature interval between, on the one hand, the old temperature value minus a maximum temperature decrease value $\Delta T_{max,down}$ and, on the other hand, the old temperature value plus a maximum temperature increase value $\Delta T_{max,up}$. This allows an excessive decrease or increase in the second reference temperature to be avoided. This limitation of the highest temperature value is performed by a third limitation operator $LIM_3$.

Here, it is possible for a predefined time interval $\Delta t$ to be determined for control of the old temperature value to the second desired temperature value, wherein the maximum temperature decrease value $\Delta T_{max,down}$ and the maximum temperature increase value $\Delta T_{max,up}$ are positively dependent on a length of this predefined time interval $\Delta t$.

Optionally, the second desired temperature value can still be limited according to a fourth temperature interval between a third minimum temperature limit value $T_{min,3}$ on the one hand and a third maximum temperature limit value $T_{max,3}$ on the other hand.

If the second reference temperature is the temperature of the gas at the outlet 4 of the oil-injected element 2, the third minimum temperature limit value $T_{min,3}$ may be set as a value between, for example, 20° C. and 80° C. with an accuracy of, for example, 1° C. to prevent condensate formation at the outlet 4.

Alternatively, the third minimum temperature value $T_{min,3}$ may be set as a high value of, for example, 105° C. if the oil injection pipe network 6 is further provided with a heat recovery system (not shown in FIG. 1) by which heat can be recovered from the oil separated by the oil separator 24 to a heat absorbing fluid. Such a high value for the third minimum temperature value $T_{min,3}$ allows the heat recovery system to recover a higher amount of heat from the oil in the oil injection pipe network 6 even at relatively high temperatures for the heat absorbing fluid.

The third maximum temperature limit value $T_{max,3}$ can be set as a value between, for example, 100° C. and 120° C. with an accuracy of, for example, 1° C.

The second desired temperature value thus determined in the computational unit 14 is further used in the control unit 15 to determine the required apportioning proportion on the basis of a first ratio $\beta_1$ between the first current value $\alpha_1$ for the second reference temperature and this second desired temperature value.

The required apportioning proportion can be determined as a continuous proportion between a minimum zero value and a maximum value of 100% depending on the first ratio $\beta_1$ according to a first monotonically increasing function.

On the other hand, the required apportioning proportion can also be determined as a binary proportion which, during operation of the device 1

- is a maximum value of 100% when the first current value $\alpha_1$
- is higher than the second desired temperature value or the second desired temperature value plus a second safety margin; or
- is higher during a first period than the second desired temperature value or the second desired temperature value plus the second safety margin; and
- is otherwise a minimum zero value.

Here, the second safety margin can be set to a value between, for example, 0° C. and 20° C. with an accuracy of, for example, 0.1° C.

The first period can be set to a value between, for example, 0 seconds and 255 seconds.

On the basis of the required apportioning proportion determined by the control unit 15, the apportioning means 8 is then actuated to actually achieve this required apportioning proportion.

A required speed of the fan 9 for controlling the first reference temperature to the first desired temperature value is determined using the second computational control unit 22.

For this purpose, the required speed is selected as a highest speed value from a set of, in this case, three speed values. This is illustrated in FIG. 2 with a second maximization operator $MAX_2$.

A first speed value $v_1$ in the said set is in that case representative of a speed value of the fan 9 required to achieve the second desired temperature value for the second reference temperature.

In a first operating regime in which the device 1 is yet to warm up, that is, when a fourth current value $\alpha_4$ for the second reference temperature is lower than a predefined minimum temperature of, for example, 90° C. needed to end this first warm-up operating regime, the first speed value $v_1$ is equal to a zero value.

In a second operating regime of the device 1 wherein the fourth current value $\alpha_4$ is higher than the predefined minimum temperature, the first speed value $v_1$ is still equal to a zero value when the apportioning proportion is lower than a predefined minimum apportioning proportion or the fourth current value $\alpha_4$ is lower than the second desired temperature value.

The predefined minimum apportioning proportion can, for example, be set as a value between, for example, 0% and, for example, 100% with an accuracy of, for example, 1%.

On the other hand, in the second operating regime, when the fifth current value as for the apportioning proportion is higher than the predefined minimum apportioning proportion and the fourth current value $\alpha_4$ is higher than the second desired temperature value, the first speed value $v_1$ is determined on the basis of at least

- the sixth current value $\alpha_6$ representative of the operating pressure; and
- the seventh current value $\alpha_7$ representative of the temperature of the gas at the inlet 3.

When the motor 5 is a variable-speed motor, when the first speed value $v_1$ is determined, the eleventh current value $\alpha_{11}$ representative of the rotational speed of the motor 5 is also taken into account, for example according to the following equation:

$$v_1 = v_{1,raw} = E \cdot \alpha_{11} + F \cdot \alpha_7 + G \cdot \alpha_6 + H \quad \text{(equation 7)}$$

Here, the current value $\alpha_{11}$ is a value for the rotational speed of the motor 5 determined as a percentage of the maximum rotational speed of the motor 5.

In the preceding equation 7, the first speed value $v_1$ is determined as a percentage of a maximum speed of the fan 9, the sixth current value $\alpha_6$ as the operating pressure in bar, and the seventh current value $\alpha_7$ as the temperature of the gas at the inlet 3 in ° C.

If the second reference temperature is the temperature of the gas at the outlet 4 of the oil-injected element 2, possible value intervals for the constants E, F, G and H in equation 7 are:

$$\{E \in \mathbb{Z} \mid 0 \le E \le 64000\} \quad \text{(equation 8)}$$

$$\{F \in \mathbb{Z} \mid 0\,(°\,C.)^{-1} \le F \le 1000\,(°\,C.)^{-1}\} \quad \text{(equation 9)}$$

$$\{G \in \mathbb{Z} \mid 0\,(\text{bar})^{-1} \le G \le 255\,(\text{bar})^{-1}\} \quad \text{(equation 10)}$$

$$\{H \in \mathbb{Z} \mid -32000 \le H \le 32000\} \quad \text{(equation 11)}$$

When in this case

- the fourth current value $\alpha_4$ is higher than the second desired temperature value plus a first tolerance value; or
- during a second period, the fourth current value $\alpha_4$ is higher than the second desired temperature value plus the first tolerance value; or
- the fourth current value $\alpha_4$ is lower than the second desired temperature value minus a second tolerance value; or
- during a third period, the fourth current value $\alpha_4$ is lower than the second desired temperature value minus the second tolerance value, the first speed value $v_1$ is further determined on the basis of at least

- the fifth current value $\alpha_5$ for the apportioning proportion; and
- a second ratio $\beta_2$ between the fourth current value $\alpha_4$ and the second desired temperature value.

The first tolerance value and the second tolerance value can, for example, be set between a value of, for example, 0° C. and, for example, 20° C. with an accuracy of, for example, 0.1° C.

The second period and third period can, for example, be set between a value of, for example, 0 seconds and, for example, 255 seconds.

The first speed value $v_1$ is in this case preferably dependent on the second ratio $\beta_2$ according to a second monotonically increasing function, and alternatively or additionally preferably dependent on the fifth current value $\alpha_5$ according to a third monotonically increasing function, for example according to the following equation:

$$v_1 = v_{1,raw} \cdot \alpha_5 \wedge P \cdot \beta_2 \wedge Z \quad \text{(equation 12)}$$

In this equation 12, the fifth current value is determined as the percentage apportioning proportion of the first part of the oil.

Possible value intervals for the constants P and Z in equation 12 are:

$$P = 0\text{–}4 \quad \text{(equation 13)}$$

$$Z = 0\text{–}4 \quad \text{(equation 14)}$$

A second speed value $v_2$ in the said set is determined as follows:

when the eighth current value $\alpha_8$ for the lowest available temperature in the aftercooler 25 is higher than the value for the required lowest available temperature, the second speed value $v_2$ is determined on the basis of the first speed value $v_1$; and a third ratio $\beta_3$ between the eighth current value $\alpha_8$ and the value for the required lowest available temperature;

otherwise, the second speed value $v_2$ is set equal to zero.

The required lowest available temperature is equal to a value for a second condensation temperature of the gas in the aftercooler 25 plus an offset.

The second speed value $v_2$ is preferably dependent on the third ratio $\beta_3$ according to a fourth monotonically increasing function. When the eighth current value $\alpha_8$ for the lowest available temperature in the aftercooler 25 is higher than the value for the required lowest available temperature, the second speed value $v_2$ is calculated, for example, according to the following equation:

$$v_2 = v_1 \cdot \beta_3 \wedge P \quad \text{(equation 15)}$$

In the preceding equation 15, the second speed value $v_2$ is determined as a percentage of the maximum speed of the fan 9.

A possible value interval for the constant P is already given in equation 13.

A third speed value $v_3$ in the said set is determined on the basis of the ninth current value $\alpha_9$ for the first reference temperature; and the predefined maximum value for the first reference temperature, wherein the third speed value $\alpha_9$ is equal to zero when the ninth current value $\alpha_9$ is lower than the predefined maximum value; and a value representative of the maximum speed of the fan 9 when the ninth current value $\alpha_9$ is higher than the predefined maximum value.

The predefined maximum value can, for example, be set between a value of, for example, 90° C. and, for example, 120° C. with an accuracy of, for example, of 1° C.

Finally, on the basis of the required speed determined by the second computational control unit 22, the second motor 12 is actuated to actually run the fan 9 at the required speed.

The present invention is by no means limited to the embodiments described as examples and shown in the figure, but a method, computational control device or device according to the invention can be implemented in all kinds of variants without departing from the scope of the invention as defined in the claims.

The invention claimed is:

1. A method for controlling a first reference temperature in a device (1) for compressing gas to a first desired temperature value, wherein the device (1) comprises:

an oil-injected element (2) for suctioning the gas at an inlet (3) of the device (1) and compressing this gas to an operating pressure at an outlet (4) of the oil-injected element (2);

an oil injection pipe network (6) with a discharge (7) for injecting oil into the oil-injected element (2), comprising:

an apportioning means (8) for apportioning the oil into a first part and into a second part;

an oil cooler (10) cooled by a fan (9), for cooling the first part; and a bypass (11) for diverting the second part past the oil cooler (10), wherein the method comprises:

determining a required apportioning proportion of the first part for directing a second reference temperature in the device (1) to a second desired temperature value;

controlling an apportioning proportion of the first part to the required apportioning proportion;

determining a required speed of the fan (9) for directing the first reference temperature to the first desired temperature value, wherein, if the first reference temperature is the same as the second reference temperature, determining the required speed on the basis of the second desired temperature value and the apportioning proportion; and controlling a speed of the fan (9) to the required speed, wherein the apportioning proportion is controlled using a control unit (15) on the basis of a non-fuzzy logic algorithm with the following as input:

a first current value al for the second reference temperature; and the second desired temperature value.

2. The method according to claim 1, wherein the second desired temperature value is determined on the basis of a highest temperature value in a group of one or more temperature values.

3. The method according to claim 2, wherein a first temperature value T1 in the said group is representative of a value Tcond of the second reference temperature at which a temperature of the compressed gas at the outlet (4) is equal to a first condensation temperature of the compressed gas at the outlet (4); or the first condensation temperature plus a first safety margin.

4. The method according to claim 3, wherein the first temperature value T1 is limited according to a first temperature interval between a first minimum temperature limit value Tmin,1 and a first maximum temperature limit value Tmax,1.

5. The method according to claim 2, wherein a second temperature value T2 in the said group is representative of a value of the second reference temperature at which a specific energy requirement of the device (1) is minimal.

6. The method according to claim 5, wherein the second temperature value T2 is determined on the basis of at least a second current value α2 representative of the operating pressure; and a third current value α3 representative of a temperature of the gas at the inlet (3).

7. The method according to claim 6, wherein, in the case that the oil-injected element (2) is driven by a variable-speed motor, the second temperature value T2 and/or the first speed value v1, respectively, is further determined on the basis of a tenth current value α10 and eleventh current value α11, respectively, which are representative of a rotational speed of the variable-speed motor.

8. The method according to claim 5, wherein the second temperature value T2 is limited according to a second temperature interval between a second minimum temperature limit value Tmin,2 and a second maximum temperature limit value Tmax,2.

9. The method according to claim 2, wherein the second reference temperature is controlled from an old temperature value to the second desired temperature value; and to determine the second desired temperature value, the said highest temperature value is limited according to a third temperature interval between, on the one hand, the old temperature value minus a maximum temperature decrease value ΔTmax,down and, on the other hand, the old temperature value plus a maximum temperature increase value ΔTmax,up.

10. The method according to claim 9, wherein the second reference temperature is controlled from the old temperature value to the second desired temperature value in a predefined time interval Δt, and that the maximum temperature decrease value ΔTmax,down and the maximum temperature increase value ΔTmax,up are positively dependent on a length of the predefined time interval Δt.

11. The method according to claim 2, wherein the required apportioning proportion is determined according to a first ratio β1 between the first current value α1 and the second desired temperature value.

12. The method according to claim 11, wherein the required apportioning proportion, between a minimum zero value and a maximum value of 100%, is dependent on the first ratio β1 according to a first monotonically increasing function.

13. The method in accordance with claim 11, wherein the required apportioning proportion has a maximum value of 100% when the first current value α1 is higher than the second desired temperature value or the second desired temperature value plus a second safety margin; or is higher during a first period than the second desired temperature value or the second desired temperature value plus the second safety margin;

and has otherwise a minimum zero value.

14. The method according to claim 1, wherein the second reference temperature is a temperature of the gas at the outlet (4) of the oil-injected element (2); or is a temperature of the oil at the discharge (7) of the oil injection pipe network (6).

15. The method according to claim 1, wherein the required speed is determined on the basis of a highest speed value in a set of one or more speed values.

16. The method according to claims 15, wherein a first speed value v1 in the said set is representative of a value for the speed of the fan (9) required to achieve the second desired temperature value for the second reference temperature.

17. The method according to claim 16, wherein, when a fourth current value α4 for the second reference temperature is higher than a predefined minimum temperature; and a fifth current value α5 for the apportioning proportion is higher than a predefined minimum apportioning proportion and the fourth current value α4 is higher than the second desired temperature value, the first speed value v1 is determined on the basis of at least a sixth current value α6 representative of the operating pressure; and a seventh current value α7 representative of a temperature of the gas at the inlet (3).

18. The method according to claim 17, wherein, when the fourth current value α4 is higher than the second desired temperature value plus a first tolerance value; or during a second period, the fourth current value α4 is higher than the second desired temperature value plus the first tolerance value; or the fourth current value α4 is lower than the second desired temperature value minus a second tolerance value; or during a third period, the fourth current value α4 is lower than the second desired temperature value minus the second tolerance value, the first speed value v1 is further determined on the basis of at least the fifth current value α5 for the apportioning proportion; and a second ratio β2 between the fourth current value α4 and the second desired temperature value.

19. The method according to claim 18, wherein the first speed value v1 is dependent on the second ratio β2 according to a second monotonically increasing function.

20. The method according to claim 18, wherein the first speed value v1 is dependent on the fifth current value α5 according to a third monotonically increasing function.

21. The method according to claim 15, wherein, when the device (1) is provided with an aftercooler (25) for cooling the compressed gas downstream of the oil-injected element (2), when an eighth current value α8 for a lowest available temperature in the aftercooler (25) is higher than a value for a required lowest available temperature, a second speed value v2 in the set is determined on the basis of the first speed value v1; and a third ratio β3 between the eighth current value α8 and the value for the required lowest available temperature; and otherwise, the second speed value v2 is set equal to zero.

22. The method according to claim 21, wherein the required lowest available temperature is equal to a value for a second condensation temperature of the gas in the aftercooler (25) plus an offset.

23. The method according to claim 21, wherein the second speed value v2 is dependent on the third ratio β3 according to a fourth monotonically increasing function.

24. The method according to claim 15, wherein a third speed value v3 in the set is determined on the basis of a ninth current value α9 for the first reference temperature; and a predefined maximum value for the first reference temperature, wherein the third speed value v3 is equal to zero when the ninth current value α9 is lower than the predefined maximum value; and a value representative of a maximum speed of the fan (9) when the ninth current value α9 is higher than the predefined maximum value.

25. A computational control assembly comprising a first computational control unit (13) provided with a control unit (15) for controlling a second reference temperature in a device (1) for compressing gas to a second desired temperature value; and a second computational control unit (22) for controlling a first reference temperature in the device (1) to a first desired temperature value for performing a method according to claim 1.

26. A device for compressing gas provided with a computational control assembly according to claim 25.

* * * * *